US009427714B2

(12) United States Patent
Sakai

(10) Patent No.: US 9,427,714 B2
(45) Date of Patent: Aug. 30, 2016

(54) MIXER DRUM APPARATUS HAVING BLADES AND INLET SEAL

(75) Inventor: Naoto Sakai, Fukaya (JP)

(73) Assignee: KYB Corporation, Tokyo (JP)

( * ) Notice: Subject to any disclaimer, the term of this patent is extended or adjusted under 35 U.S.C. 154(b) by 536 days.

(21) Appl. No.: 13/979,929

(22) PCT Filed: Aug. 8, 2012

(86) PCT No.: PCT/JP2012/070169

§ 371 (c)(1),
(2), (4) Date: Jul. 16, 2013

(87) PCT Pub. No.: WO2013/077033

PCT Pub. Date: May 30, 2013

(65) Prior Publication Data

US 2013/0294191 A1 Nov. 7, 2013

(30) Foreign Application Priority Data

Nov. 25, 2011 (JP) ..... 2011-257640

(51) Int. Cl.

| | |
|---|---|
| ***B28C 5/42*** | (2006.01) |
| ***B01F 9/02*** | (2006.01) |
| ***B28C 5/08*** | (2006.01) |
| ***B01F 9/06*** | (2006.01) |
| ***B28C 5/20*** | (2006.01) |
| ***B01F 9/00*** | (2006.01) |

(52) U.S. Cl.

CPC ..... *B01F 9/02* (2013.01); *B01F 9/0032* (2013.01); *B01F 9/06* (2013.01); *B28C 5/0818* (2013.01); *B28C 5/2054* (2013.01); *B28C 5/4237* (2013.01); *B28C 5/4268* (2013.01)

(58) Field of Classification Search

CPC . B28C 5/4237; B28C 5/0818; B28C 5/4262; B28C 7/168; B28C 5/4268; B28C 5/2054; B01F 9/02; B01F 9/06; B01F 9/0032

USPC ..... 366/53–63, 68, 187

See application file for complete search history.

(56) References Cited

U.S. PATENT DOCUMENTS 2,750,164 A * 6/1956 MacKinney ..... B28C 5/4237 366/59
2,763,474 A * 9/1956 Smith ..... B28C 5/4237 366/41

(Continued)

FOREIGN PATENT DOCUMENTS

| | | | |
|---|---|---|---|
| GB | 2263072 | A | 7/1993 |
| JP | 56-139514 | U | 10/1981 |
| JP | 58-101708 | U | 7/1983 |
| JP | 8-040136 | A | 2/1996 |
| JP | 2006-315466 | A | 11/2006 |

OTHER PUBLICATIONS

International Search Report and Written Opinion corresponding to PCT/JP2012/070169, dated Sep. 4, 2012.

Extended European Search Report mailed Jun. 25, 2015, corresponding to European patent application No. 12851525.1.

*Primary Examiner* — Charles Cooley

(74) *Attorney, Agent, or Firm* — Hauptman Ham, LLP

(57) ABSTRACT

A mixer drum apparatus to stir material to be stored includes a freely-rotatable drum having an opening end opened at one end to receive the material to be stored therein, a plurality of spirally-shaped blades provided inside the drum to have a phase difference, and an inlet seal provided at the opening end of the drum and connected partially to the blades. The inlet seal located between the blades forms an opening causing the material to be stored to pass through.

4 Claims, 11 Drawing Sheets

(56) References Cited

U.S. PATENT DOCUMENTS 2,854,224 A * 9/1958 Broberg ..... B28C 5/4237 366/41
2,879,978 A * 3/1959 Hilkemeier ..... B28C 5/4268 366/41
2,884,235 A * 4/1959 Broberg ..... B28C 5/4237 366/41
2,902,268 A * 9/1959 Broberg ..... B28C 5/4237 366/41
2,904,318 A * 9/1959 Broberg ..... B28C 5/4262 366/41
3,061,282 A * 10/1962 Hilkemeier ..... B28C 5/4237 366/41
2013/0294191 A1* 11/2013 Sakai ..... B01F 9/06 366/165.2

* cited by examiner

MIXER DRUM APPARATUS HAVING BLADES AND INLET SEAL

RELATED APPLICATIONS

The present application is a National Phase of International Application Number PCT/JP2012/070169, filed Aug. 8, 2012, and claims priority from Japanese Application Number 2011-257640 Nov. 25, 2011.

TECHNICAL FIELD

The present invention relates to a mixer drum apparatus to stir material to be stored such as ready-mixed concrete.

BACKGROUND ART

JP8-40136A discloses a mixer drum apparatus mounted on a concrete mixer truck. This mixer drum apparatus includes a rotating drum, a hopper that directs charged ready-mixed concrete to the drum, an inlet seal that is provided at an opening end of the drum and is connected to the hopper, and a pair of blades that spirally extend from the opening end of the drum to the front side of the concrete mixer truck (back side of the drum).

The inlet seal has an inlet seal pipe that is connected to an outlet of the hopper, and a pair of inlet seal panels that extend from the inlet seal pipe to the back side of the drum to be connected to inner peripheries of the blades.

When charging the ready-mixed concrete, the inlet seal pipe directs the ready-mixed concrete that is charged to the hopper to the back side of the drum.

At the time of stirring or mixing with the ready-mixed concrete being loaded closer to a maximum load, the inlet seal panels receive the ready-mixed concrete that is over the inner peripheries of the blades in the vicinity of the opening end of the drum, thereby preventing the ready-mixed concrete from being discharged from the opening end of the drum.

SUMMARY OF THE INVENTION

According to the above-described conventional mixer drum apparatus, however, the inlet seal panels are provided over the inner peripheries of the pair of blades that are arranged in a front-to-rear direction in the vicinity of the opening end of the drum, and space between the blades arranged in the front-to-rear direction is covered by the inlet seal panels like a tunnel. This makes it likely that the ready-mixed concrete adheres between the pair of blades, and makes it difficult to clean the ready-mixed concrete adhered between the blades, at the time of cleaning inside the drum.

It is an object of the present invention to provide a mixer drum apparatus in which material to be stored, such as ready-mixed concrete, is less likely to adhere between blades, and is capable of improving cleaning performance.

According to one aspect of the present invention, a mixer drum apparatus to stir material to be stored is provided which comprises a freely-rotatable drum having an opening end opened at one end to receive the material to be stored therein; a plurality of spirally-shaped blades provided inside the drum to have a phase difference; and an inlet seal provided at the opening end of the drum and connected partially to the blades, wherein the inlet seal located between the blades forms an opening causing the material to be stored to pass through.

Embodiments of the present invention and advantages thereof are described in detail below with reference to the accompanying drawings.

EMBODIMENTS OF THE INVENTION

A first embodiment will be explained with reference to FIG. 1 to FIG. 6.

Figure 1:
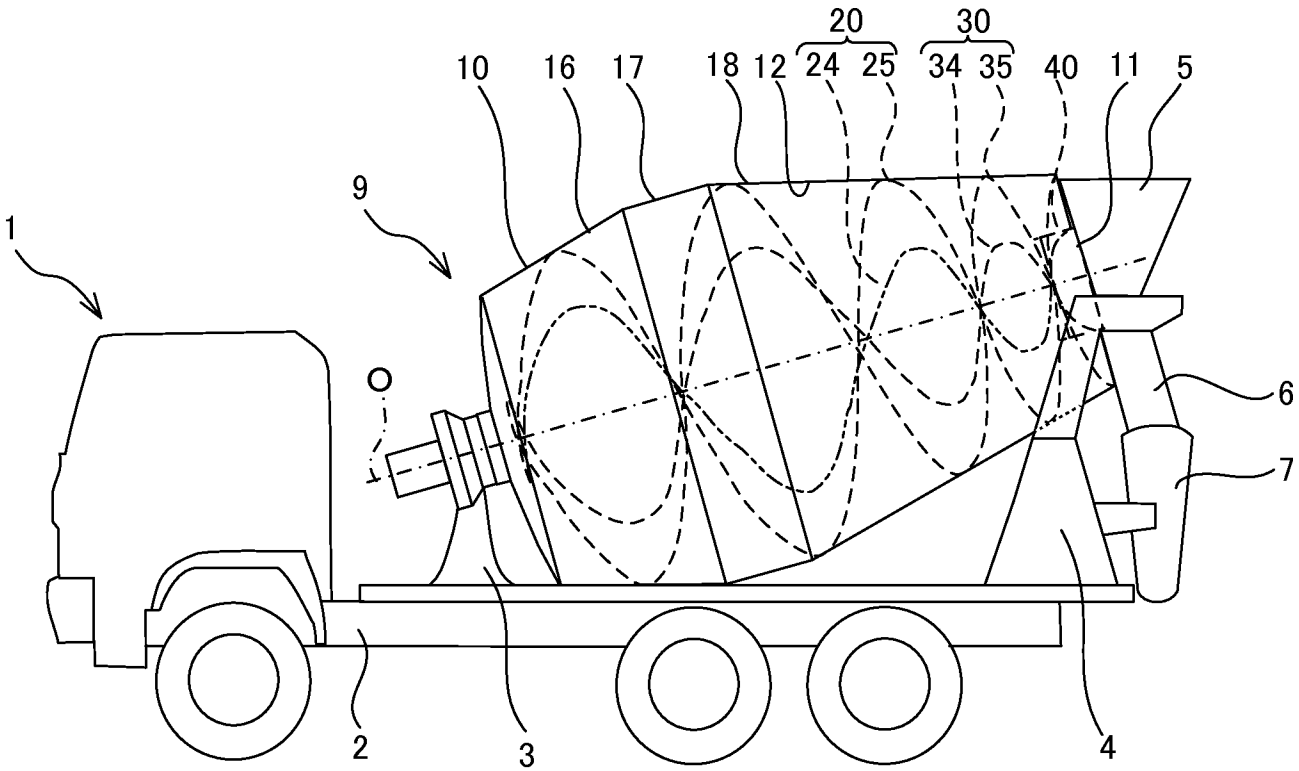
FIG. 1 is a side view showing a concrete mixer truck according to a first embodiment.

FIG. 1 is a side view showing schematic structure of a concrete mixer truck 1. The concrete mixer truck 1 for loading ready-mixed concrete is equipped with a mixer drum apparatus 9 to stir the ready-mixed concrete on a vehicle body 2.

The mixer drum apparatus 9 includes supporting units 3 and 4 that are provided in the front and in the rear of the vehicle body 2, a drum 10 that is supported by the supporting units 3 and 4 freely-rotatable around a rotation center axis O, and a not-shown driving unit that transmits power of an engine to the drum 10. The mixer drum apparatus 9 drives the drum 10 to rotate in both normal and reverse rotation directions.

The hollow spindle-shaped drum 10 has a cylindrical portion 17 that is provided at the center thereof, a front conical portion 16 that reduces its diameter from the cylindrical portion 17 to the front of the concrete mixer truck (left side in FIG. 1), and a rear conical portion 18 that reduces its diameter from the cylindrical portion 17 to the rear of the concrete mixer truck (right side in FIG. 1).

In the rear of the drum 10, an opening end 11 for charging and discharging the ready-mixed concrete (charging and discharging port) is provided. The drum 10 is arranged in such a manner that its rotation center axis O is tilted relative to a horizontal line. Therefore, the opening end 11 of the drum 10 opens diagonally upward.

A hopper 5 for charging the ready-mixed concrete is provided in the upper rear of the opening end 11 of the drum 10. An inlet seal 40 is provided inside the opening end 11 of the drum 10. The ready-mixed concrete charged to the hopper 5 is guided by the inlet seal 40 from the opening end 11 of the drum 10 into the drum 10.

A scoop 6 and a chute 7 are provided in the lower rear of the opening end 11 of the drum 10. The ready-mixed concrete discharged from the opening end 11 is guided by the scoop 6 to the chute 7, and discharged by the chute 7 in a predetermined direction.

Inside the drum 10, a first blade 20 and a second blade 30, each of which has a belt shape and projects from an inner wall 12 to extend spirally, are provided. A pair of first blade 20 and second blade 30, each extending in the spiral belt shape, has a phase difference of 180° to each other about the rotation center axis O.

The first blade 20 has a spiral-shaped outer periphery (base end) 25 that is connected to the inner wall 12 of the drum 10, and a spiral-shaped inner periphery (tip end) 24 that is extended from the outer periphery 25 toward the inside of the drum 10. Similarly, the second blade 30 has a spiral-shaped outer periphery (base end) 35 that is connected to the inner wall 12 of the drum 10, and a spiral-shaped inner periphery (tip end) 34 that is extended from the outer periphery 35 toward the inside of the drum 10.

At the time of charging, stirring and mixing the ready-mixed concrete to and in the drum 10, the drum 10 is driven to rotate normally and rotated in a counterclockwise direction viewed from the rear (right end side in FIG. 1). The ready-mixed concrete in the drum 10 is transferred from the rear to the front of the drum 10 (from the right to the left in FIG. 1) by the rotating first blade 20 and second blade 30. Thus, the ready-mixed concrete is stirred and mixed and its solidification is prevented.

At the time of discharging the ready-mixed concrete from the drum 10, the drum 10 is driven to rotate reversely and rotated in a clockwise direction viewed from the rear. The ready-mixed concrete in the drum 10 is transferred from the front to the rear of the drum 10 by the rotating first blade 20 and second blade 30 and discharged from the opening end 11 of the drum 10.

Figure 2:
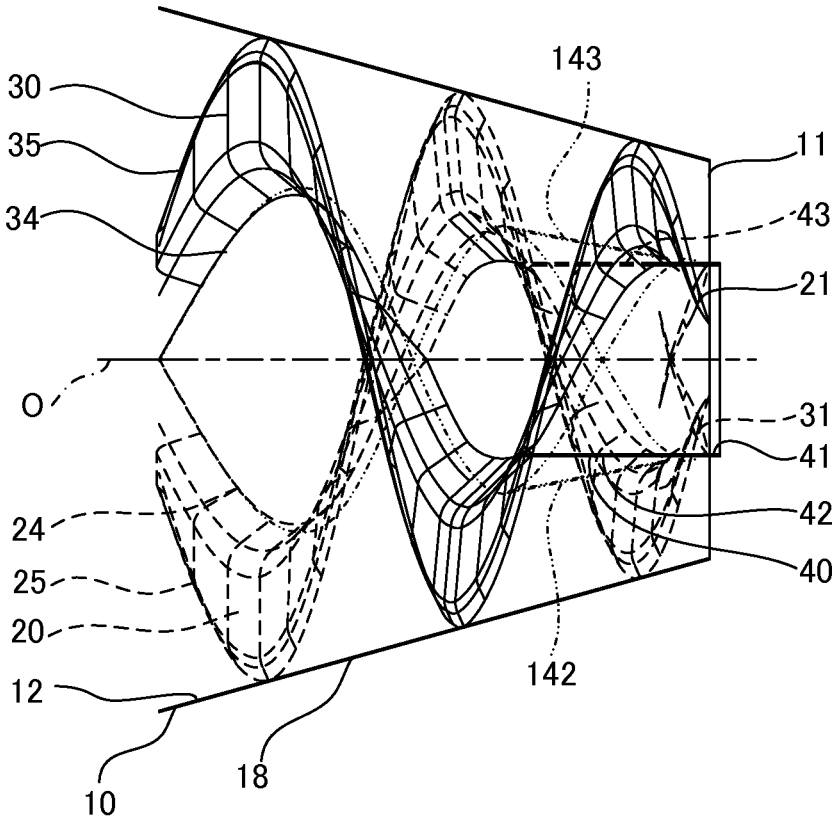
FIG. 2 is a cross-sectional view of a drum.

In FIG. 2, the first blade 20 is illustrated by broken lines and the second blade 30 is illustrated by solid lines. The first blade 20 in the spiral belt shape has a tapered first blade tip end portion 21 that extends to the vicinity of the opening end 11 of the drum 10, and the second blade 30 in the spiral belt shape has a tapered second blade tip end portion 31 that extends to the vicinity of the opening end 11 of the drum 10. The first blade tip end portion 21 and the second blade tip end portion 31 reduce in height with respect to the inner wall 12 of the drum 10 gradually from the front side (back side) of the drum 10 toward the opening end 11.

Figure 3:
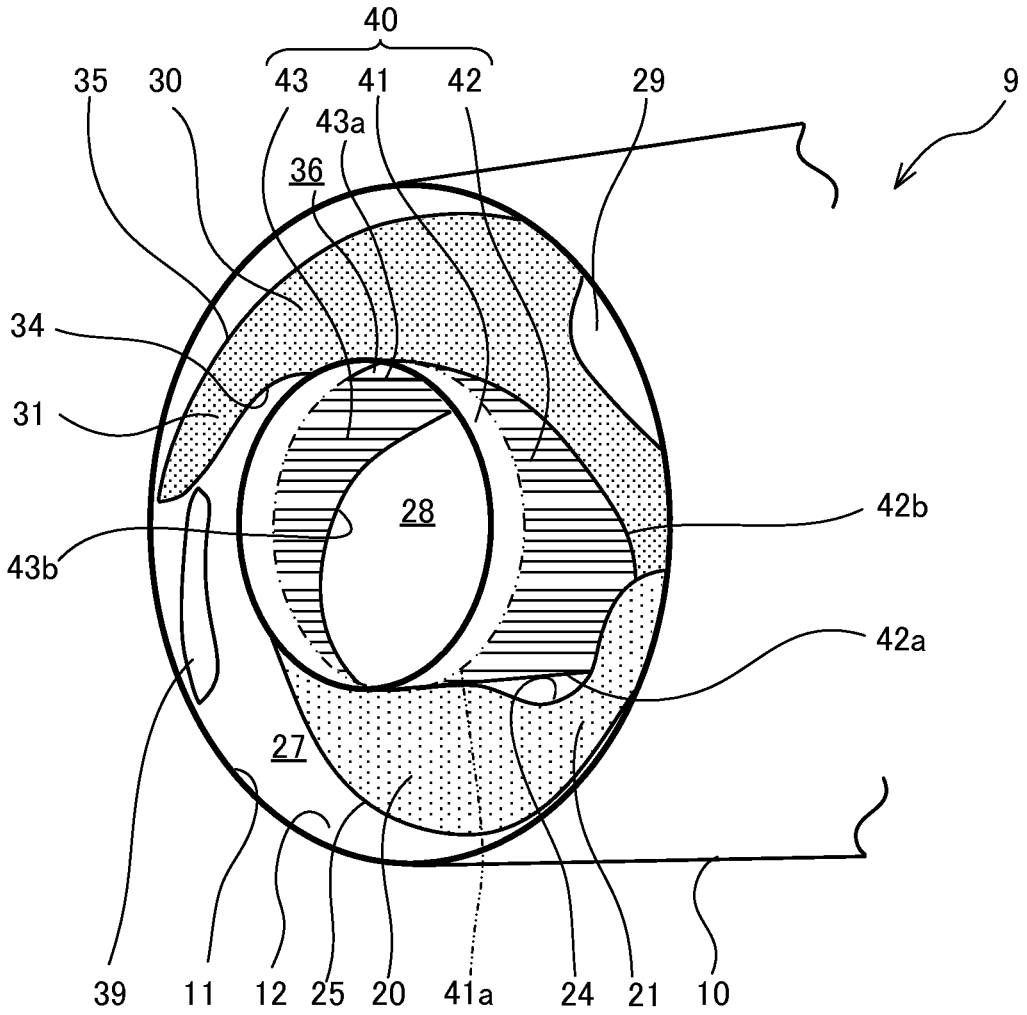
FIG. 3 is a perspective view of the drum viewed from a diagonally rear right direction.
Figure 4:
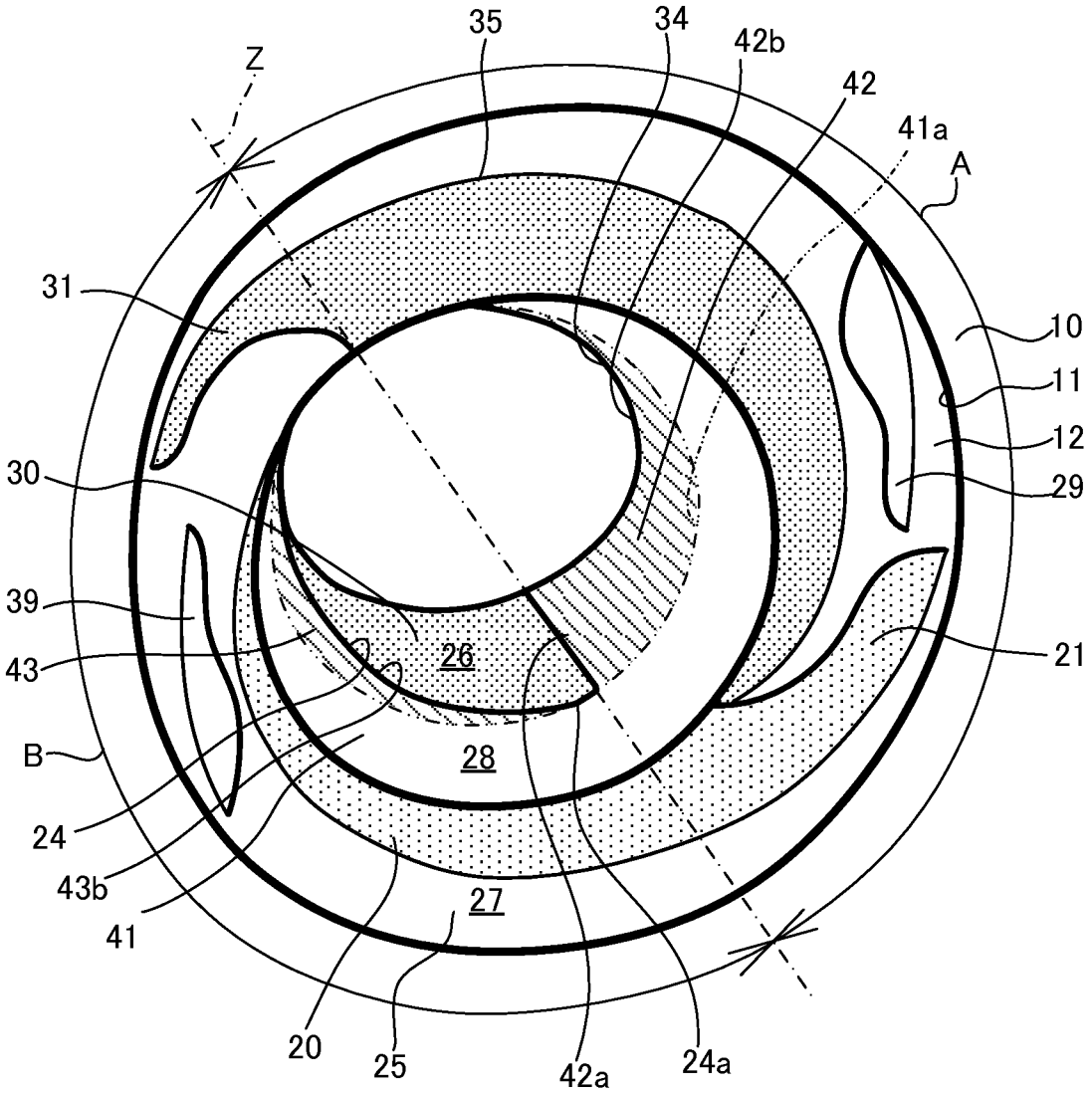
FIG. 4 is a perspective view of the drum viewed from a diagonally rear left direction.

As shown in FIG. 3 and FIG. 4, a pair of auxiliary blades 29 and 39 that extend from the inner wall 12 is provided in the vicinity of the opening end 11 of the drum 10. The auxiliary blades 29 and 39 are arranged to have a phase difference of 180° with respect to each other and to have a predetermined phase difference with respect to the first blade tip end portion 21 and the second blade tip end portion 31, respectively.

When the drum 10 is rotated reversely to discharge the ready-mixed concrete, the ready-mixed concrete is transferred to the vicinity of the opening end 11 of the drum 10 by the first blade 20 and the second blade 30, and pushed out from the opening end 11 of the drum 10 to the scoop 6 by the tapered first blade tip end portion 21 and second blade tip end portion 31 and the auxiliary blades 29 and 39.

Figure 5:
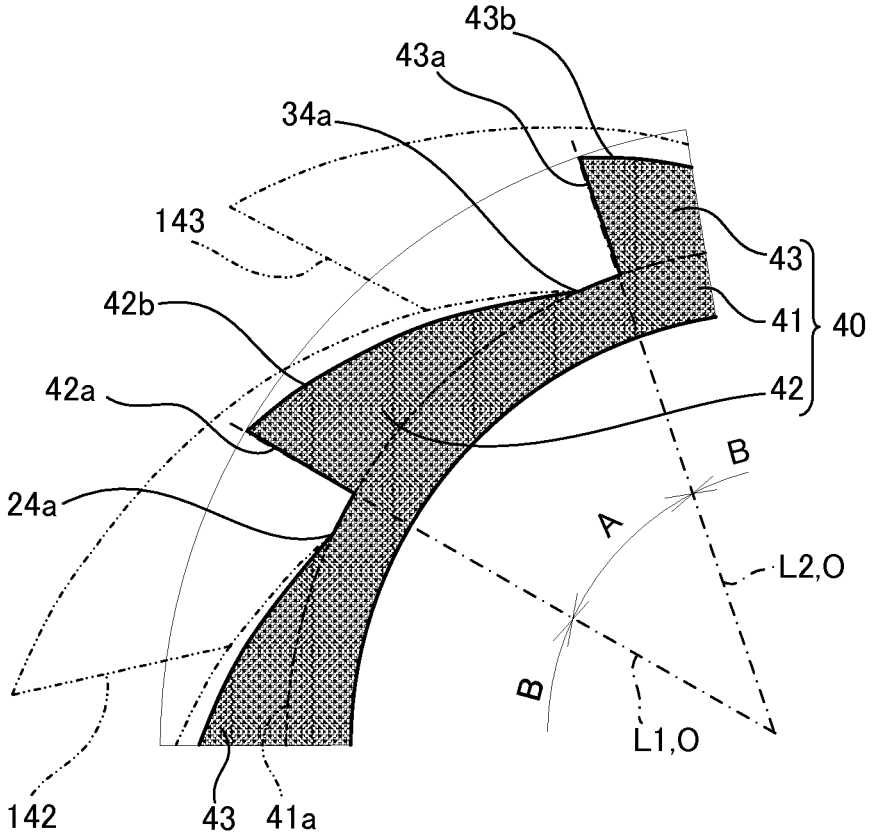
FIG. 5 is an expanded view of an inlet seal.
Figure 6:
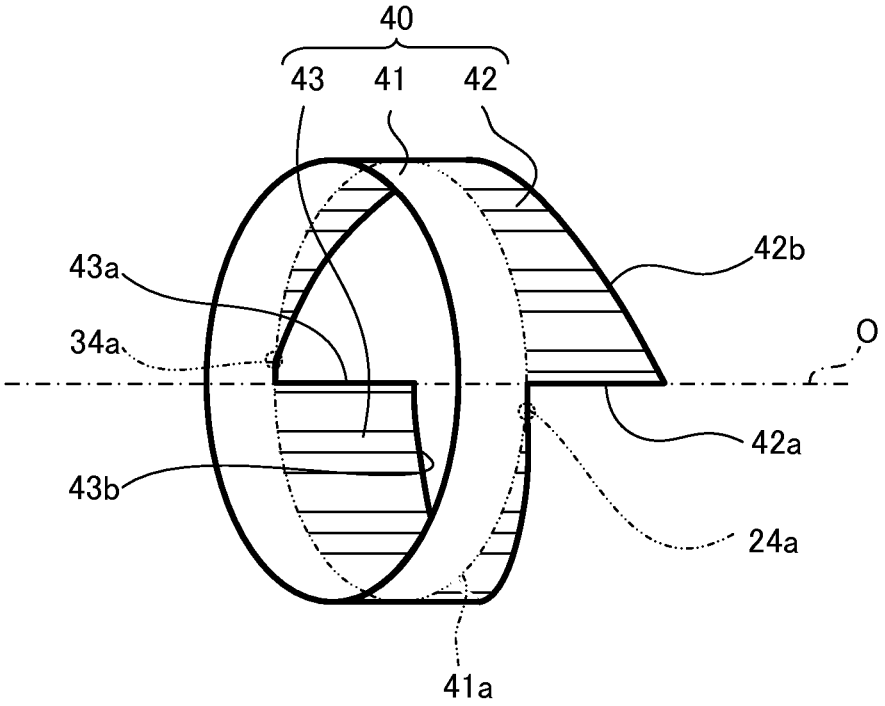
FIG. 6 is a perspective view of the inlet seal.

Hereinafter, structure of the inlet seal 40 will be explained. FIG. 5 is an expanded view of the inlet seal 40, and FIG. 6 is a perspective view of the inlet seal 40. The inlet seal 40 has an inlet seal pipe 41 having an annular shape, and a first inlet seal panel 42 and a second inlet seal panel 43 each extending in a curved triangular plate shape from the inlet seal pipe 41.

The inlet seal pipe 41 is formed to have the annular shape around the rotation center axis O. An outlet (not shown) of the hopper 5 is connected to an opening end of the inlet seal pipe 41. An inlet space 28 defined inside the inlet seal pipe 41 communicates with the hopper 5 to introduce the ready-mixed concrete.

When the drum 10 rotates normally to charge the ready-mixed concrete, the ready-mixed concrete charged to the hopper 5 is guided by the inlet seal pipe 41 to the front side (back side) of the drum 10 over the first blade tip end portion 21 and the second blade tip end portion 31.

The first inlet seal panel 42 and the second inlet seal panel 43 are arranged to have a phase difference of 180° to each other about the rotation center axis O. Each of the first inlet seal panel 42 and the second inlet seal panel 43 is formed to have the curved triangular plate shape extending to connect the front end of the inlet seal pipe 41 and the inner peripheries 24 and 34 of the first blade 20 and the second blade 30, respectively.

The inlet seal pipe 41, the first inlet seal panel 42 and the second inlet seal panel 43 are separately formed by a metal plate and connected to each other by welding and the like. Incidentally, the inlet seal pipe 41, the first inlet seal panel 42 and the second inlet seal panel 43 may be formed as one unit.

When the drum 10 is rotated normally to stir or mix the ready-mixed concrete, with the ready-mixed concrete being loaded closer to a maximum load, the ready-mixed concrete that is over the inner peripheries 24 and 34 of the first blade 20 and the second blade 30 gets onto the first inlet seal panel 42 and the second inlet seal panel 43, in the vicinity of the opening end 11 of the drum 10. This makes it possible to prevent the ready-mixed concrete from being discharged from the opening end 11 of the drum 10 to the scoop 6.

Incidentally, according to a conventional concrete mixer truck, inlet seal panels 142 and 143 of the inlet seal are formed in a conical shape (tapered cylindrical shape) that increases its diameter along the rear conical portion of the drum, and the pair of blades arranged in the front-to-rear direction in the vicinity of the opening end of the drum is formed to have approximately the same extension height, as shown by two-dotted chain lines in FIG. 2. Therefore, it was necessary to provide the inlet seal panels 142 and 143 over a wide area in the vicinity of the opening end of the drum, in order to prevent the ready-mixed concrete from getting over the blades and being discharged. As a result, space between the blades arranged in the front-to-rear direction is covered by the inlet seal panels 142 and 143 like a tunnel, which makes it likely that the ready-mixed concrete adheres between the blades, and makes it difficult to clean the ready-mixed concrete adhered between the blades at the time of cleaning the concrete mixer truck.

For this reason, the inlet seal 40 of this embodiment is structured to make the space open between the first blade 20 and the second blade 30 that are arranged in the direction of the rotation center axis O of the drum 10, and not to cover the space between the first blade 20 and the second blade 30 like a tunnel.

Each of regions A and B, as shown in FIG. 4 and FIG. 5, is set to have an angular range of 180° about the rotation center axis O, with a center line Z at the end of the drum forming a border therebetween. In the region A, the first blade tip end portion 21 exists as a portion of the first blade 20 separated from the inlet seal pipe 41. In the region B, the second blade tip end portion 31 exists as a portion of the second blade 30 separated from the inlet seal pipe 41.

An annular outlet space 27 is defined between the inlet seal pipe 41 and the opening end 11 of the drum 10. The outlet space 27 opens toward the outside of the drum 10 as the first blade tip end portion 21 and the second blade tip end portion 31 are separated from the inlet seal pipe 41 in the regions A and B.

The first inlet seal panel 42 is arranged in the region A so as not to cover the space between the first blade 20 and the second blade 30 like a tunnel. The second inlet seal panel 43 is arranged in the region B so as not to cover the space between the first blade 20 and the second blade 30 like a tunnel.

A first opening 26 is defined in the region B by a first seal side portion 42*a* of the first inlet seal panel 42, to make the space open between the first blade 20 and the second blade 30 (refer to FIG. 3 and FIG. 4).

A second opening 36 is defined in the region A by a second seal side portion 43*a* of the second inlet seal panel 43, to make the space open between the first blade 20 and the second blade 30 (refer to FIG. 3 and FIG. 4).

Thereby, the space between the first blade 20 and the second blade 30 that are arranged in the front-to-rear direction is not covered by the first inlet seal panel 42 and the second inlet seal panel 43 like a tunnel. This makes it difficult for the ready-mixed concrete to adhere between the first blade 20 and the second blade 30, and makes it easy to clean the space between the first blade 20 and the second blade 30 at the time of cleaning inside the drum 10.

The inlet seal pipe 41 has a first blade connecting portion 24*a* and a second blade connecting portion 34*a* that are connected to the inner peripheries (tip ends) 24 and 34 of the first blade 20 and the second blade 30.

The first inlet seal panel 42 has a front side seal end portion (front end portion) 42*b* that extends from the inlet seal pipe 41 to the back side (front) of the drum 10 to be connected to the inner periphery 34 of the second blade 30.

Similarly, the second inlet seal panel 43 has a front side seal end portion (front end portion) 43*b* that extends from the inlet seal pipe 41 to the back side (front) of the drum 10 to be connected to the inner periphery 24 of the first blade 20.

The center line Z at the end of the drum is a line orthogonal to the rotation center axis O of the drum 10. The first inlet seal panel 42 has the first seal side portion 42*a* that touches the center line Z at the end of the drum and extends in approximately parallel to the rotation center axis O of the drum 10. The second inlet seal panel 43 has the second seal side portion 43*a* that touches the center line Z at the end of the drum and extends in approximately parallel to the rotation center axis O of the drum 10.

The expanded view in FIG. 5 shows the first inlet seal panel 42 and the second inlet seal panel 43 according to this embodiment in solid lines. Supposing that the lines extending from the inlet seal pipe 41 in approximately parallel to the rotation center axis O of the drum 10 are reference lines L1 and L2, the first seal side portion 42*a* and the second seal side portion 43*a* are formed to extend along the reference lines L1 and L2 in an approximately linear manner.

The first inlet seal panel 42 is formed in the curved triangular plate shape that extends to connect the first seal side portion 42*a*, a front end 41*a* of the inlet seal pipe 41, and the inner periphery 34 of the second blade 30. The second blade connecting portion 34*a* becomes a sharply-angled tip end (vertex) of the first inlet seal panel 42. The first seal side portion 42*a* is offset with respect to the second blade connecting portion 34*a* toward the second blade tip end portion 31 (refer to FIG. 5). This makes it possible to prevent the first inlet seal panel 42 from blocking the space between the first blade 20 and the second blade 30 arranged in the front-to-rear direction. It should be noted that the first seal side portion 42*a* may be connected to the second blade connecting portion 34*a*.

Similarly, the second inlet seal panel 43 is formed in the curved triangular plate shape that extends to connect the second seal side portion 43*a*, the front end 41*a* of the inlet seal pipe 41, and the inner periphery 24 of the first blade 20. The first blade connecting portion 24*a* becomes a sharply-angled tip end (vertex) of the second inlet seal panel 43. The second seal side portion 43*a* is offset with respect to the first blade connecting portion 24*a* toward the first blade tip end portion 21 (refer to FIG. 5). This makes it possible to prevent the second inlet seal panel 43 from blocking the space between the first blade 20 and the second blade 30 arranged in the front-to-rear direction. It should be noted that the second seal side portion 43*a* may be connected to the first blade connecting portion 24*a*.

As the first inlet seal panel 42 and the second inlet seal panel 43 are not provided in the first opening 26 and the second opening 36, the space between the first blade 20 and the second blade 30 arranged in the front-to-rear direction is opened.

The first opening 26 is defined spirally among the first seal side portion 42*a* of the first inlet seal panel 42, the inner periphery 24 of the first blade 20, and the inner periphery 34 of the second blade 30.

The second opening 36 is defined spirally among the second seal side portion 43*a* of the second inlet seal panel 43, the inner periphery 34 of the second blade 30, and the inner periphery 24 of the first blade 20.

The first opening 26 and the second opening 36 are juxtaposed in a circumferential direction to have a phase difference of 180° to each other about the rotation center axis O of the drum 10, each of which has a shape spirally cutting off a semicylindrical surface having the rotation center axis O at the center.

As the first inlet seal panel 42 and the second inlet seal panel 43 do not form the tunnel-shaped space between the first blade 20 and the second blade 30, it is difficult for the ready-mixed concrete (material to be stored) to adhere between the first blade 20 and the second blade 30. Moreover, as the space between the first blade 20 and the second blade 30 is opened, it is easy to clean between the first blade 20 and the second blade 30 by spraying water thereon, at the time of cleaning the inside of the drum 10.

In the expanded view in FIG. 5, the inlet seal panels 142 and 143 according to the conventional apparatus are illustrated by two-dotted chain lines. While the first inlet seal panel 42 and the second inlet seal panel 43 according to this embodiment make the space open between the first blade 20 and the second blade 30 arranged in the front-to-rear direction, the inlet seal panels 142 and 143 according to the conventional apparatus are provided to cover the space between the first blade 20 and the second blade 30 arranged in the front-to-rear direction like a tunnel.

The first inlet seal panel 42 and the second inlet seal panel 43 according to this embodiment are extended in approximately parallel to the rotation center axis O of the drum 10, and are formed along a cylindrical surface that is continued from the inlet seal pipe 41.

The extension heights of the first blade 20 and the second blade 30 with respect to the inner wall 12 of the drum 10 are set according to the shapes of the first inlet seal panel 42 and the second inlet seal panel 43 so that the front side seal end portions (front end portions) 42*b* and 43*b* of the first inlet seal panel 42 and the second inlet seal panel 43 are connected without a difference in level to the inner peripheries 24 and 34 of the first blade 20 and the second blade 30.

Thereby, in the vicinity of the opening end 11 of the drum 10, the heights of the first blade 20 and the second blade 30 are greater on the front side (back side) that is far from the opening end 11, than on the back side that is closer to the opening end 11. This makes it possible to prevent the ready-mixed concrete from getting over the inner peripheries 24 and 34 of the first blade 20 and the second blade 30, in the vicinity of the opening end 11 of the drum 10.

When the drum 10 is rotated normally to stir or mix the ready-mixed concrete, with the ready-mixed concrete being loaded closer to the maximum load, the ready-mixed concrete that gets over the inner peripheries 24 and 34 of the first blade 20 and the second blade 30 gets onto the first inlet seal panel 42, the second inlet seal panel 43 and the inside of the inlet seal 40. This makes it possible to prevent the ready-mixed concrete from dropping to the opening end 11 side (outlet space 27) of the drum 10. Namely, in the area where the first inlet seal panel 42 and the second inlet seal panel 43 are not provided, the ready-mixed concrete that gets over the inner peripheries 24 and 34 of the first blade 20 and the second blade 30 drops to the space between the first blade 20 and the second blade 30 arranged in the front-to-rear direction, and is transferred back to the front side (back side) of the drum 10 by the rotating first blade 20 and the second blade 30. This makes it possible to prevent the ready-mixed concrete from flowing toward the opening end 11 side (outlet space 27) of the drum 10. Therefore, it is possible for the drum 10 to secure the load capacity equal to that of the conventional apparatus having the large inlet seal.

Next, a second embodiment will be explained with reference to FIG. 7 to FIG. 10.

Figure 7:
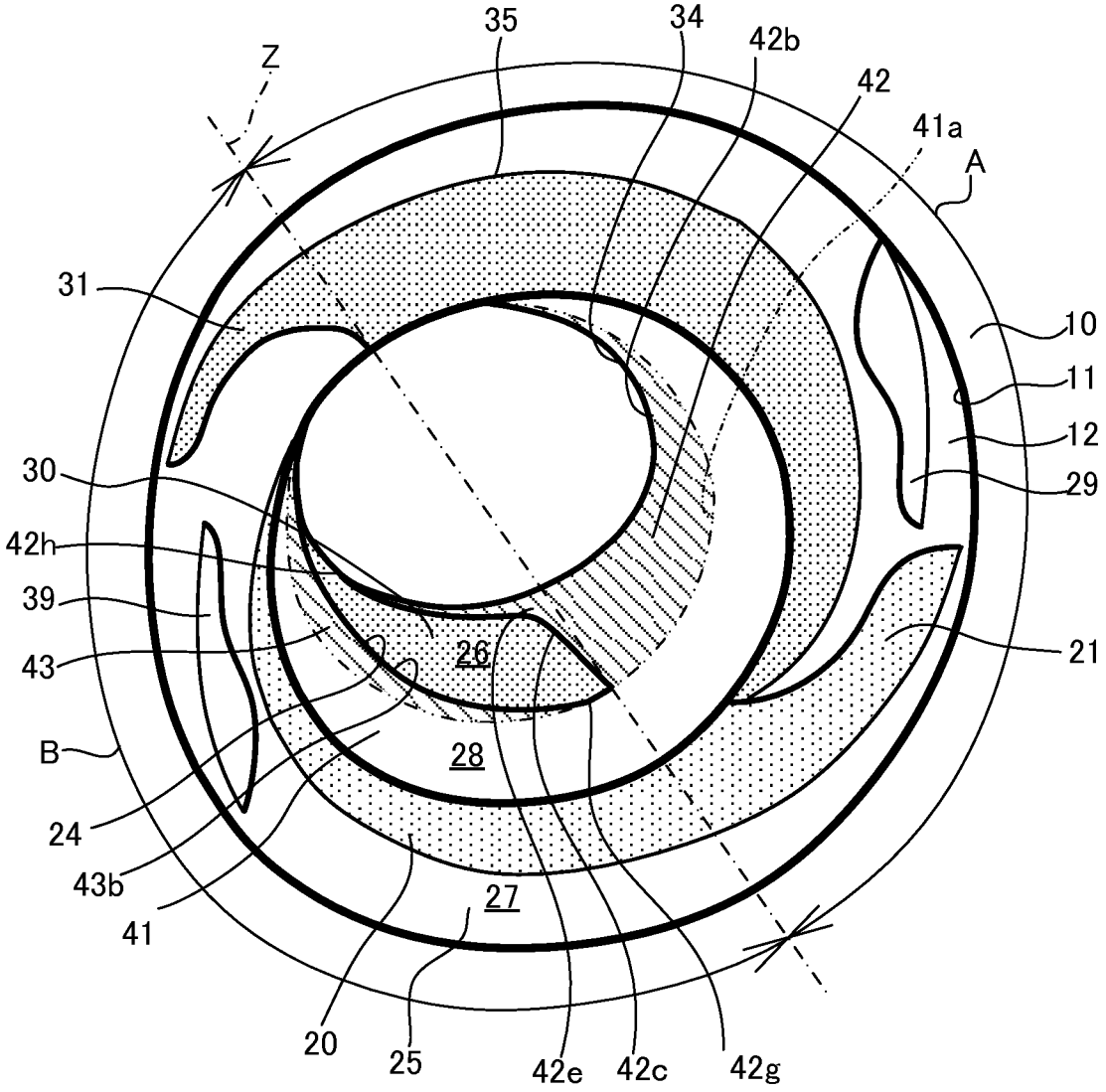
FIG. 7 is a perspective view of the drum according to a second embodiment viewed from a diagonally rear left direction.
Figure 8:
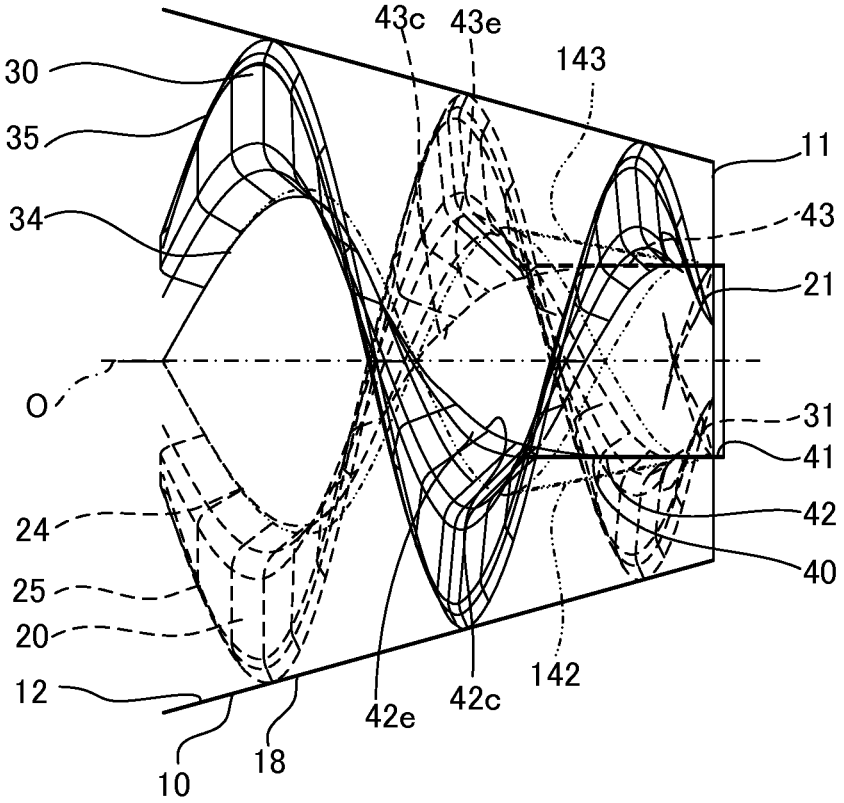
FIG. 8 is a cross-sectional view of the drum.
Figure 9:
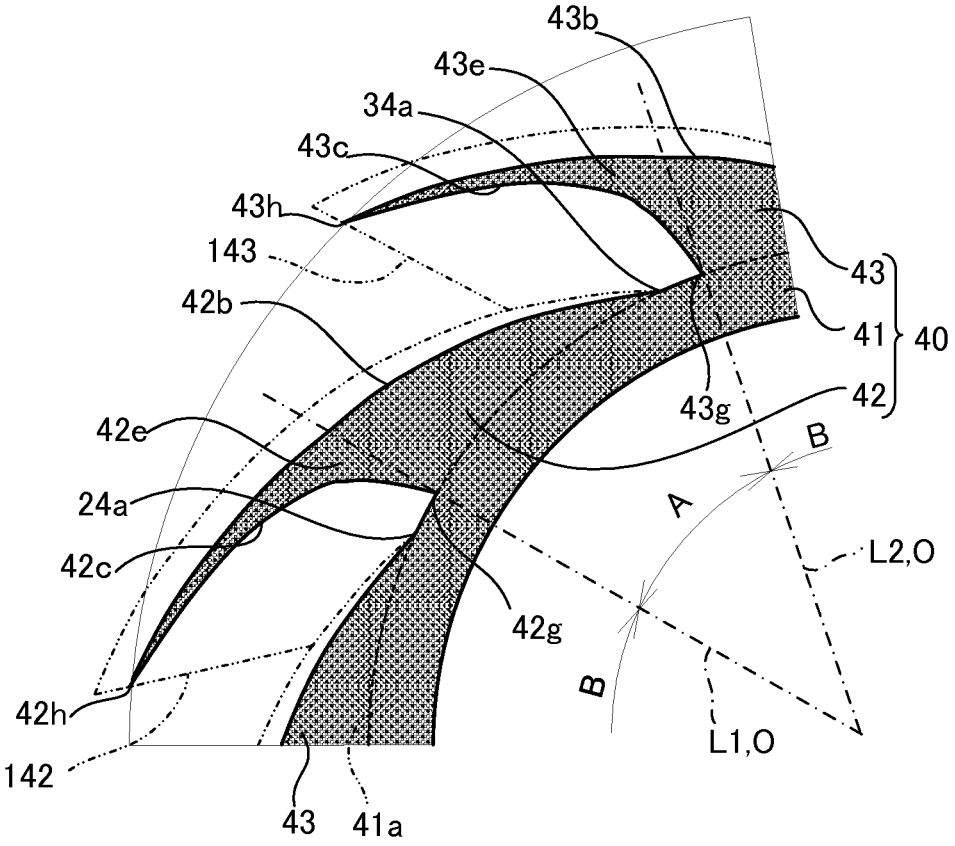
FIG. 9 is an expanded view of the inlet seal.
Figure 10:
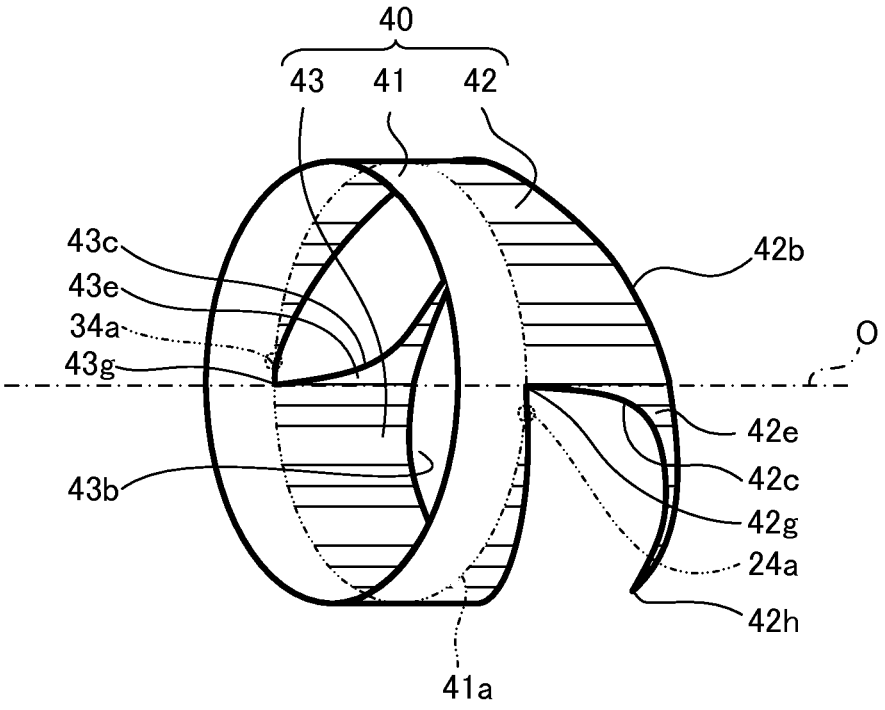
FIG. 10 is a perspective view of the inlet seal.

FIG. 7 is a perspective view of the drum viewed from a diagonally rear left direction. FIG. 8 is a cross-sectional view showing schematic structure of the mixer drum apparatus 9. FIG. 9 is an expanded view of the inlet seal 40. FIG. 10 is a perspective view of the inlet seal 40. Structure of the mixer drum apparatus of this embodiment is basically the same as that of the first embodiment, and hence explanations are given only to the parts that are different from those of the first embodiment. Incidentally, the identical reference signs are given to the elements identical to those of the first embodiment.

The first inlet seal panel 42 has a first extended portion 42*e* that extends along the inner peripheries 24 and 34 of the first blade 20 and the second blade 30 in front. The second inlet seal panel 43 has a second extended portion 43*e* that extends along the inner peripheries 24 and 34 of the first blade 20 and the second blade 30 in front.

The first inlet seal panel 42 has a first seal side portion 42*c* that extends to curve along the reference line L1 and the inner periphery 34 of the second blade 30. The second inlet seal panel 43 has a second seal side portion 43*c* that extends to curve along the reference line L2 and the inner periphery 24 of the first blade 20.

Respective rear ends 42*g* and 43*g* of the first extended portion 42*e* and the second extended portion 43*e* are arranged at the front end 41*a* of the inlet seal pipe 41. Respective front ends 42*h* and 43*h* of the first extended portion 42*e* and the second extended portion 43*e* are arranged at positions separated from the reference lines L1 and L2 of the inner peripheries 24 and 34 of the first blade 20 and the second blade 30 toward the front (back side).

Extension widths of the first extended portion 42*e* and the second extended portion 43*e*, extending in a rotation circumferential direction of the drum 10 from the reference lines L1 and L2, gradually increase from the rear ends 42*g* and 43*g* toward the front (back side).

Extension widths of the first extended portion 42*e* and the second extended portion 43*e*, extending in a rotation axis direction of the drum 10 from the inner peripheries 24 and 34 of the first blade 20 and the second blade 30, gradually increase from the front ends 42*h* and 43*h* toward the rear (opening end 11 side).

At the time of stirring or mixing, the ready-mixed concrete that gets over the inner peripheries 24 and 34 of the first blade 20 and the second blade 30 gets onto the first extended portion 42*e* and the second extended portion 43*e* of the first inlet seal panel 42 and the second inlet seal panel 43. This makes it possible to prevent the ready-mixed concrete from flowing toward the opening end 11 side (outlet space 27) of the drum 10. Therefore, it is possible for the drum 10 to secure the load capacity equal to or greater than that of the conventional apparatus having the large inlet seal.

In the expanded view in FIG. 9, the first inlet seal panel 42 and the second inlet seal panel 43 of this embodiment are illustrated by solid lines, and the first inlet seal panel 142 and the second inlet seal panel 143 of the conventional apparatus are illustrated by two-dotted chain lines. As the first inlet seal panel 42 and the second inlet seal panel 43 are structured to make the space open between the first blade 20 and the second blade 30 arranged in the front-to-rear direction, it is less likely that the ready-mixed concrete (material to be stored) adheres between the first blade 20 and the second blade 30, as compared with the first inlet seal panel 142 and second inlet seal panel 143 of the conventional apparatus. Moreover, as the space between the first blade 20 and the second blade 30 is opened, it is easy to clean between the first blade 20 and the second blade 30 by spraying water thereon, at the time of cleaning the inside of the drum 10.

According to this embodiment as described thus far, it is easy to clean the inside of the drum 10, similarly to the first embodiment, and also it is possible to increase the load capacity to be greater than that of the first embodiment. When the load capacity is the same as that of the first embodiment, it is possible to downsize the drum 10.

Next, a third embodiment will be explained with reference to FIG. 11.

Figure 11:
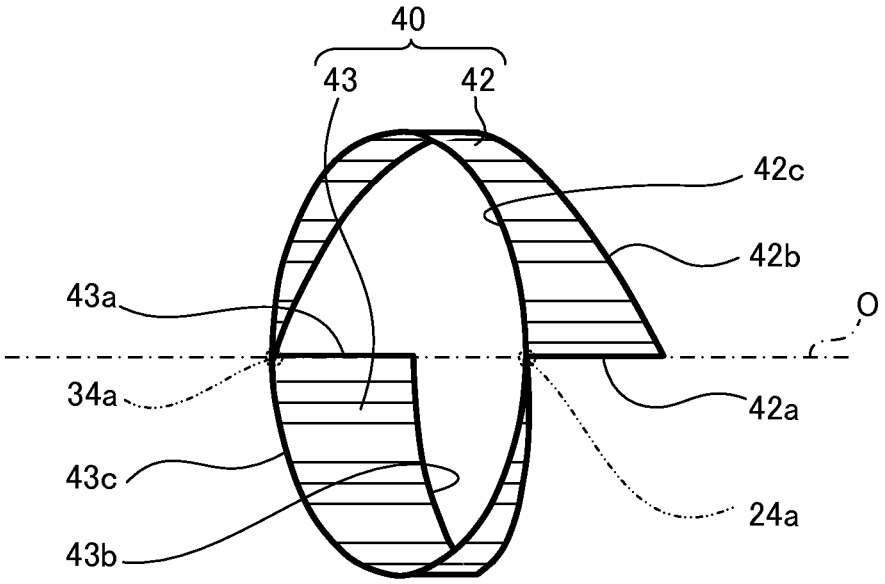
FIG. 11 is a perspective view of the inlet seal according to a third embodiment.

FIG. 11 is a perspective view of the inlet seal 40. Structure of the mixer drum apparatus of this embodiment is basically the same as that of the first embodiment, and hence explanations are given only to the parts that are different from those of the first embodiment. Incidentally, the identical reference signs are given to the elements identical to those of the first embodiment.

The inlet seal 40 does not have the inlet seal pipe 41 of the first embodiment, and is formed by the first inlet seal panel 42 and the second inlet seal panel 43 only, each having the curved triangular plate shape.

The first inlet seal panel 42 is formed in the curved triangular plate shape that extends to connect the first blade connecting portion 24*a* and the inner periphery 34 of the second blade 30.

The first inlet seal panel 42 has the first seal side portion 42*a* that extends from the first blade connecting portion 24*a* in approximately parallel to the rotation center axis O of the drum 10, the front side seal end portion 42*b* that is connected to the inner periphery 34 of the second blade 30, and a backside seal end portion 42*c* that connects the first blade connecting portion 24*a* and the second blade connecting portion 34*a*. The first blade connecting portion 24*a* becomes a sharply-angled tip end (vertex) of the second inlet seal panel 43.

The second inlet seal panel 43 is formed in the curved triangular plate shape that extends to connect the second blade connecting portion 34*a* and the inner periphery 24 of the first blade 20.

The second inlet seal panel 43 has the second seal side portion 43*a* that extends from the second blade connecting portion 34*a* in approximately parallel to the rotation center axis O of the drum 10, the front side seal end portion 43*b* that is connected to the inner periphery 24 of the first blade 20, and a backside seal end portion 43*c* that connects the second blade connecting portion 34*a* and the blade connecting portion 24*a* of the first blade 20. The second blade connecting portion 34*a* becomes a sharply-angled tip end (vertex) of the first inlet seal panel 42. Incidentally, the first inlet seal panel 42 and the second inlet seal panel 43 may be structured to include the first extended portion 42*e* and the second extended portion 43*e* that are extended along the inner peripheries 24 and 34 of the first blade 20 and the second blade 30 in front (refer to FIG. 8).

Thereby, the first inlet seal panel 42 and the second inlet seal panel 43, each having the curved triangular plate shape, do not cover the space between the first blade 20 and the second blade 30 that are arranged in the front-to-rear direction like a tunnel. The first seal side portion 42*a* defines the first opening 26 that makes the space open between the first blade 20 and the second blade 30, and the second seal side portion 43*a* defines the second opening 36 that makes the space open between the first blade 20 and the second blade 30.

At the time of stirring or mixing the mixer drum apparatus 9, the ready-mixed concrete that gets over the inner peripheries 24 and 34 of the first blade 20 and the second blade 30 gets onto the first inlet seal panel 42 and the second inlet seal panel 43, in the vicinity of the opening end 11 of the drum 10. This makes it possible to prevent the ready-mixed concrete from dropping to the opening end 11 side (outlet space 27) of the drum 10. Namely, in the area where the first inlet seal panel 42 and the second inlet seal panel 43 are not provided, the ready-mixed concrete getting over the inner peripheries 24 and 34 of the first blade 20 and the second blade 30 drops to the space between the first blade 20 and the second blade 30 arranged in the front-to-rear direction, and is transferred back to the front side (back side) of the drum 10 by the rotating first blade 20 and the second blade 30. This makes it possible to prevent the ready-mixed concrete from flowing toward the opening end 11 side (outlet space 27) of the drum 10.

In the area where the first inlet seal panel 42 and the second inlet seal panel 43 are not provided, the space between the first blade 20 and the second blade 30 that are arranged in the front-to-rear direction is opened. As the first inlet seal panel 42 and the second inlet seal panel 43 do not form the tunnel-shaped space between the first blade 20 and the second blade 30, it is difficult for the ready-mixed concrete to adhere between the first blade 20 and the second blade 30. Moreover, as the space between the first blade 20 and the second blade 30 is opened, it is easy to clean between the first blade 20 and the second blade 30 by spraying water thereon, at the time of cleaning the inside of the drum 10.

The third embodiment does not have the inlet seal pipe as described above, and therefore, a hopper on a facility side can be inserted in the drum 10 when charging the ready-mixed concrete. Thus, it is possible to accept the specification that does not have the hopper at the inlet of the drum 10.

Outlines, operations and effects of the respective embodiments will be explained.

(A) The mixer drum apparatus 9 to stir the material to be stored includes the freely-rotatable drum 10 that has the opening end 11 opened at one end and receives the material to be stored therein, the plurality of blades 20 and 30 that are spirally-shaped and provided inside the drum 10 to have the phase difference, and the inlet seal 40 that is provided at the opening end 11 of the drum 10 and is connected partially to the blades 20 and 30. The inlet seal 40 located between the blades 20 and 30 forms the openings 26 and 36 causing the material to be stored to pass through (refer to FIG. 1 to FIG. 9).

When charging the ready-mixed concrete according to the above-described structure, the ready-mixed concrete (material to be stored) that is charged into the drum 10 is guided by the inlet seal 40 to the front side (back side) of the drum 10 over the blade tip end portions 21 and 31.

When the drum 10 is rotated normally to stir or mix the ready-mixed concrete, the ready-mixed concrete that gets over the inner peripheries 24 and 34 of the blades 20 and 30 gets onto the inlet seal 40, in the vicinity of the opening end 11 of the drum 10. This makes it possible to prevent the ready-mixed concrete from being discharged from the opening end 11 of the drum 10.

Meanwhile, when the drum 10 is rotated reversely to discharge the ready-mixed concrete, the ready-mixed concrete is transferred from the front to the rear of the drum 10 by the rotating blades 20 and 30 and discharged from the opening end 11 of the drum 10.

The openings 26 and 36 that are formed by the inlet seal 40 make the space open between the blades 20 and 30 that are arranged in the rotation center axis O direction of the drum 10, and therefore, the space between the blades 20 and 30 arranged in the front-to-rear direction is not covered by the inlet seal 40 like a tunnel. Thereby, it is difficult for the ready-mixed concrete (material to be stored) to adhere between the blades 20 and 30 that are arranged in the front-to-rear direction of the drum 10, and it is easy to clean between the blades 20 and 30 that are arranged in the front-to-rear direction of the drum 10, at the time of cleaning the inside of the drum 10. As a result of this, it is possible to prevent deterioration of stirring and mixing performance and discharging performance of the mixer drum apparatus 9 due to the material adhered to the blades 20 and 30.

(B) The inlet seal 40 has the seal side portions 42*a* and 43*a* that define the openings 26 and 36 to make the space open between the blades 20 and 30 arranged in the rotation center axis O direction of the drum 10 (in the front-to-rear direction of the drum 10), and the seal side portions 42*a* and 43*a* extend in the approximately linear manner along the reference lines L1 and L2 extending in approximately parallel to the rotation center axis O of the drum 10 (refer to FIG. 5).

According to the above-described structure, the seal side portions 42*a* and 43*a* make the space open between the blades 20 and 30 arranged in the front-to-rear direction of the drum 10. Thereby, it is difficult for the ready-mixed concrete (material to be stored) to adhere between the blades 20 and 30 that are arranged in the front-to-rear direction of the drum 10, and it is easy to clean between the blades 20 and 30 that are arranged in the front-to-rear direction of the drum 10, at the time of cleaning the inside of the drum 10.

As the seal side portions 42*a* and 43*a* extend in approximately parallel to the rotation center axis O of the drum 10, the heights of the blades 20 and 30 are formed greater on the front side (back side) that is far from the opening end 11, than on the back side that is closer to the opening end 11.

This makes it possible to prevent the ready-mixed concrete from getting over the inner peripheries 24 and 34 of the first blade 20 and the second blade 30, in the vicinity of the opening end 11 of the drum 10. Therefore, it is possible for the drum 10 to secure the load capacity equal to that of the conventional apparatus having the large inlet seal.

(C) The inlet seal 40 has the blade connecting portions 24*a* and 34*a* that are connected to the blades 20 and 30, in the vicinity of the opening end 11 of the drum 10, and is formed to have the curved triangular plate shapes extending from the blade connecting portions 24*a* and 34*a* to the blades 30 and 20 located on the back side of the drum 10 (refer to FIG. 11).

According to the above-described structure, the inlet seal 40 in the curved triangular plate shapes does not have the inlet seal pipe. Therefore, the hopper on the facility side can be inserted in the drum 10 when charging the ready-mixed concrete. Thus, it is possible to accept the specification that does not have the hopper at the inlet of the drum 10.

Moreover, as the inlet seal 40 does not have the annular inlet seal pipe 41, simplification of the structure is made possible.

(D) The inlet seal panels 42 and 43 have the extended portions 42*e* and 43*e* that are formed along both of the seal side portions 42*a* and 43*a* (reference lines L1 and L2) and the blades 20 and 30 (refer to FIG. 7 to FIG. 10).

At the time of stirring or mixing according to the above-described structure, the ready-mixed concrete that gets over the inner peripheries 24 and 34 of the blades 20 and 30 gets onto the extended portions 42*e* and 43*e* of the inlet seal panels 42 and 43. This makes it possible to prevent the ready-mixed concrete from flowing toward the opening end 11 side (outlet space 27) of the drum 10. Thus, it is possible to realize both of the cleaning performance and loading performance of the drum 10.

(E) The inlet seal 40 has the annular inlet seal pipe 41 that is connected to the blades 20 and 30, and the inlet seal panels 42 and 43 that extend from the inlet seal pipe 41 to the blades 20 and 30 arranged on the back side of the drum 10, in the vicinity of the opening end 11 of the drum 10 (refer to FIG. 1 to FIG. 6).

According to the above-described structure, the charged ready-mixed concrete is guided by the inlet seal pipe 41 to the inside of the drum 10. Further, at the time of stirring or mixing, the ready-mixed concrete that gets over the inner peripheries 24 and 34 of the blades 20 and 30 gets onto the inlet seal panels 42 and 43, in the vicinity of the opening end 11 of the drum 10. This makes it possible to prevent the ready-mixed concrete from being discharged from the opening end 11 of the drum 10.

Moreover, the inlet seal panels 42 and 43 make the space open between the blades 20 and 30, and therefore, the space between the blades 20 and 30 arranged in the front-to-rear direction is not covered by the inlet seal 40 like a tunnel. Thereby, it is difficult for the ready-mixed concrete (material to be stored) to adhere between the blades 20 and 30 that are arranged in the front-to-rear direction of the drum 10, and it is easy to clean between the blades 20 and 30 at the time of cleaning the inside of the drum 10.

The embodiments of the present invention described above are merely illustration of some application examples of the present invention and not of the nature to limit the technical scope of the present invention to the specific constructions of the above embodiments.

For example, the mixer drum apparatus 9 according to the above-described embodiments has the pair of first blade 20 and second blade 30, but it may be structured to have only one blade. In this case, the inlet seal has one inlet seal panel that has the seal side portion defining the opening to make the space open in one blade arranged in the rotation center axis O direction.

Alternatively, the mixer drum apparatus 9 may include three or more blades. In this case, the inlet seal has three or more inlet seal panels that have the seal side portions forming three or more openings for making the space open in the three or more blades arranged in the rotation center axis O direction.

Moreover, the material to be stored received in the mixer drum apparatus 9 is not limited to the ready-mixed concrete, and other material to be stored may be received.

The present application claims a priority based on Japanese Patent Application No. 2011-257640 filed with the Japan Patent Office on Nov. 25, 2011, all the contents of which are hereby incorporated by reference.

The invention claimed is:

1. A mixer drum apparatus configured to stir material to be stored, the mixer drum apparatus comprising:

a freely-rotatable drum having an opening end opened to receive the material;

a plurality of spirally-shaped blades provided inside the drum to have a phase difference; and an inlet seal provided at the opening end of the drum and connected partially to the blades, wherein the inlet seal has a same number of inlet seal panels as that of the blades, the inlet seal panels being located between the blades in the drum, and each of the inlet seal panels having an opening for the material to pass through, and wherein each of the inlet seal panels comprises a blade connecting portion connected to a corresponding one of the blades in a vicinity of the opening end of the drum, and has a curved triangular plate shape extending from the blade connecting portion to a corresponding blade located on a back side of the drum.

2. A mixer drum apparatus configured to stir material to be stored, the mixer drum apparatus comprising:

a freely-rotatable drum having an opening end opened to receive the material;

a plurality of spirally-shaped blades provided inside the drum to have a phase difference; and an inlet seal provided at the opening end of the drum and connected partially to the blades, wherein the inlet seal comprises the same number of inlet seal panels as that of the blades, the inlet seal panels being located between the blades in the drum, and each of the inlet seal panels having an opening to cause the material to pass through, wherein each of the inlet seal panels has a seal side portion that defines the opening, wherein the seal side portion extends in an approximately linear manner along a reference line extending approximately parallel to a rotation center axis of the drum, and has an extended portion formed along a corresponding one of the blades, and wherein each of the inlet seal panels has a blade connecting portion connected to an inner periphery of the corresponding one of the blades, and the extended portion has a rear end circumferentially spaced from the blade connecting portion of another inlet seat panel to make a space open between the blades arranged a the front-to-rear direction.

3. The mixer drum apparatus according to claim 2, wherein the inlet seal further has an annular inlet seal pipe connected to each of the blades in a vicinity of the opening end of the drum, and each of the inlet seal panel extends from the inlet seal pipe to the blade located on a back side of the drum.

4. The mixer drum apparatus according to claim 2, wherein the extended portion has a width gradually increased towards a back side of the drum.

* * * * *